US007794288B2

(12) United States Patent
Shindo et al.

(10) Patent No.: US 7,794,288 B2
(45) Date of Patent: Sep. 14, 2010

(54) CONNECTOR

(75) Inventors: Satoru Shindo, Nishikamo-gun (JP); Yuji Miyazaki, Nishikamo-gun (JP); Hiroshi Kobayashi, Toyota (JP)

(73) Assignees: J.S.T. Mfg. Co., Ltd., Osaka-shi (JP); Toyota Jidosha Kabushiki Kaisha, Toyota-shi (JP)

( * ) Notice: Subject to any disclaimer, the term of this patent is extended or adjusted under 35 U.S.C. 154(b) by 336 days.

(21) Appl. No.: 12/089,121

(22) PCT Filed: Sep. 11, 2007

(86) PCT No.: PCT/JP2007/067623

§ 371 (c)(1),
(2), (4) Date: Apr. 3, 2008

(87) PCT Pub. No.: WO2008/032689

PCT Pub. Date: Mar. 20, 2008

(65) Prior Publication Data

US 2010/0151742 A1 Jun. 17, 2010

(30) Foreign Application Priority Data

Sep. 15, 2006 (JP) ..... 2006-250634

(51) Int. Cl.
*H01R 13/64* (2006.01)

(52) U.S. Cl. ..... 439/680; 439/347

(58) Field of Classification Search ..... 439/680, 439/374, 347
See application file for complete search history.

(56) References Cited

U.S. PATENT DOCUMENTS 3,753,582 A * 8/1973 Graham ..... 285/305
4,333,699 A * 6/1982 Brorein ..... 439/592
4,365,857 A * 12/1982 Watanabe et al. ..... 439/79
4,571,017 A * 2/1986 Fujita ..... 439/603
5,219,185 A * 6/1993 Oddenino ..... 285/26
5,607,324 A * 3/1997 Saur et al. ..... 439/565
5,639,255 A * 6/1997 Muzslay ..... 439/347

(Continued)

FOREIGN PATENT DOCUMENTS

JP 5 43483 6/1993

(Continued)

*Primary Examiner*—Ross N Gushi
(74) *Attorney, Agent, or Firm*—Oblon, Spivak, McClelland, Maier & Neustadt, L.L.P.

(57) ABSTRACT

The present invention provides a connector capable of being simply and easily connected without loss of electrical continuity even in a harsh environment.

First joining terminals 201*a* and 201*b* are supported by a female housing 200, and second joining terminals 401*a* and 401*b* electrically connected to the first joining terminals 201*a* and 201*b* are supported by a male housing 400. The male housing 400 is inserted to mate with the female housing 200, which performs electrical connection. Further, slit ribs 205*a* to 205*d* are formed in the direction of mating in the female housing 200, and slits 405*a* to 405*d* along the direction of mating are formed in the male housing 400. The slit ribs 205*a* to 205*d* have recessed tapered shapes formed at a predetermined rate of angular change and a predetermined rate of width change, and the slits 405*a* to 405*d* have tapered shapes having a rate of angular change and a rate of width change which are respectively greater than the predetermined rate of angular change and the predetermined rate of width change of the slit ribs.

7 Claims, 8 Drawing Sheets

U.S. PATENT DOCUMENTS

| | | | | |
|---|---|---|---|---|
| 5,823,813 | A * | 10/1998 | Dye | 439/347 |
| 5,876,248 | A * | 3/1999 | Brunker et al. | 439/607.08 |
| 5,885,093 | A * | 3/1999 | Champion et al. | 439/101 |
| 6,086,419 | A * | 7/2000 | Marpoe, Jr. | 439/595 |
| 6,142,799 | A * | 11/2000 | Marcel | 439/152 |
| 6,332,800 | B2 * | 12/2001 | Kodama | 439/357 |
| 6,416,346 | B1 * | 7/2002 | Nakamura | 439/374 |
| 6,595,790 | B1 * | 7/2003 | Bigotto | 439/157 |
| 6,607,393 | B2 * | 8/2003 | Raypole et al. | 439/92 |
| 6,843,677 | B2 * | 1/2005 | Fukuda | 439/374 |
| 6,875,027 | B2 * | 4/2005 | Ye et al. | 439/74 |
| 6,884,106 | B2 * | 4/2005 | Shuman et al. | 439/358 |
| 6,939,163 | B2 * | 9/2005 | Fujita | 439/381 |
| 7,033,207 | B2 * | 4/2006 | Nimura | 439/489 |
| 7,479,025 | B2 * | 1/2009 | Lee et al. | 439/349 |
| 7,572,135 | B2 * | 8/2009 | Kozono et al. | 439/248 |
| 2001/0027049 | A1 * | 10/2001 | Kato et al. | 439/374 |
| 2003/0036302 | A1 * | 2/2003 | Fukuda | 439/374 |
| 2004/0077205 | A1 * | 4/2004 | Holmes et al. | 439/347 |
| 2004/0235333 | A1 * | 11/2004 | Schaich | 439/374 |
| 2006/0240716 | A1 * | 10/2006 | Kozono et al. | 439/686 |
| 2008/0233789 | A1 * | 9/2008 | Sakamoto et al. | 439/357 |
| 2009/0325416 | A1 * | 12/2009 | Shindo et al. | 439/346 |

FOREIGN PATENT DOCUMENTS

| | | |
|---|---|---|
| JP | 10 223299 | 8/1998 |
| JP | 11 312547 | 11/1999 |
| JP | 2004 171911 | 6/2004 |
| JP | 2006 79994 | 3/2006 |
| JP | 2006 202557 | 8/2006 |

* cited by examiner

A

B

C

CONNECTOR

TECHNICAL FIELD

The present invention relates to a connector capable of performing electrical continuity even in a harsh environment.

BACKGROUND ART

In recent years, in a power source (for example, an engine) used for a vehicle such as an automobile, various electronic controls have been used in order to comply with restrictions regarding fuel savings or emissions control, and the like. In order to perform these electronic controls, a sensor, an actuator, a control device (for example, an electronic control unit: ECU), cables and electrical connectors for connecting equipment, and the like are mainly required.

However, in the vicinity of a power source, in particular, a direct fuel-injection engine or the like, electrical connectors thereof are placed in a harsh environment. That is, because high-acceleration vibration is caused in the vicinity of such a power source, housings of an electrical connector are easily worn away or made defective, which makes it difficult to maintain the durability of the electrical connectors. Further, when high-acceleration vibration of a power source corresponds to a natural frequency of an electrical connector itself, the electrical connector itself falls into a mechanical resonance condition, which makes it further difficult to maintain the durability thereof.

Therefore, when an electrical connector is used in an environment in which high-acceleration vibration is caused, a method has been used in which the electrical connector is led out to a place on which there is less effect of high-acceleration vibration by a leader cable, to be used, and the electrical connector is again returned into an environment in which high-acceleration vibration is caused, with the leader cable.

However, installation of an electrical connector by use of a leader cable results in an increase in the number of components. As a result, spaces are produced among the junctions of the respective components, which cause a reduction in the vibration resistance of the electrical connector.

Further, in a connector which has been disclosed (refer to Patent Document 1), it is necessary to insert a spacer after mating of the connector, a plurality of connecting processes are required for connecting the connector. Therefore, the greater the number of connectors to be installed becomes, the greater the increase in man-hours for connection.

Patent Document 1: Japanese Published Unexamined Patent Application No. 2004-171911.

DISCLOSURE OF THE INVENTION

It is an object of the present invention to provide a connector capable of being simply and easily connected without loss of electrical continuity even in a harsh environment.

It is another object of the present invention to provide a connector which has resistance to high-acceleration vibration, and is lightweight and capable of being downsized.

(1)

A connector according to the present invention includes a female-type first housing supporting first joining terminals, a male-type second housing which supports second joining terminals electrically connected to the first joining terminals, and which is inserted into the first housing to mate with the first housing, and a latch metal which is latched into slits extending in one direction perpendicular to a direction of mating of the first housing and the second housing and formed in the first housing, and biases the second housing in a direction perpendicular to both of the direction of mating and a direction of the slits, and any one of the first housing and the second housing has tapered slit ribs which extend in the direction of mating, and are formed at a predetermined rate of width change and a predetermined rate of angular change, any other one of the first housing and the second housing has tapered slits which are provided at positions corresponding to the slit ribs and extend in the direction of mating of the first housing and the second housing, and have a rate of angular change and a rate of width change which are respectively greater than the predetermined rate of angular change and the predetermined rate of width change of the slit ribs, and when the second housing is made to mate with the first housing, outer wall surfaces of the slit ribs are fitted into inner peripheral surfaces of the slits, and slits of the slit ribs become narrower, and the slit ribs are pressed to fit into the slits.

In the connector according to the present invention, the first joining terminals are supported by the first housing, and the second joining terminals electrically connected to the first joining terminals are supported by the second housing. The second housing is inserted to mate with the first housing, which performs electrical connection. Further, the slit ribs are formed in the direction of mating in any one of the first housing and the second housing, and the slits along the direction of mating are formed in any other one of the first housing and the second housing. The slit ribs have recessed tapered shapes formed at a predetermined rate of angular change and a predetermined rate of width change, and the slits have tapered shapes having a rate of angular change and a rate of width change which are respectively greater than the predetermined rate of angular change and the predetermined rate of width change of the slit ribs.

In this case, the slit ribs are inserted into the tapered shapes of the slits, and because the rate of angular change and the rate of width change of the slits are greater than the rate of angular change and the rate of width change of the slit ribs, a state in which force is always applied between the slits and the slit ribs is brought about. That is, the slit widths of the slit ribs become narrower to be inserted into the slits. Further, because the mating faces among the slits and the slit ribs are formed into the tapered shapes, it is possible to reduce the mating force at the time of mating. As a result, it is possible to make the first housing and the second housing rigid, and it is possible to prevent vibration between the first housing and the second housing even in an environment of high-acceleration vibration. Accordingly, it is possible to suppress abrasion between the first housing and the second housing, and to reliably keep the connections among the first joining terminals and the second joining terminals.

(2)

The tapered slit ribs and the tapered slits may be provided in at least three pairs or more respectively to the first housing and the second housing.

In this case, because the slits and the slit ribs are provided in at least three pairs or more, it is possible to have a resistance characteristic to vibration in a direction of rotation centering on the direction of mating at the time of mating of the first housing and the second housing.

(3)

The second housing is formed such that a shape of a cross section on a plane perpendicular to the direction of mating is a rectangular shape, and any one of the slits and the slit ribs may be formed on every corner portion of the rectangular shape, and the first housing is formed of a rectangular shape which covers the periphery of the second housing, and capable of mating with the shape of the cross section of the second housing, and any other one of the slit ribs and the slits capable of mating with one of the slits and the slit ribs of the second housing formed on every corner portion of the rectangular shape of the second housing may be formed thereon.

In this case, any one of the slits and the slit ribs are formed on the corner portions of the rectangular shape of the second housing, and the other one of the slits and the slit ribs are formed on the corner portions of the first housing. For example, when slit ribs are provided at two corner places of the second housing, and slits are provided at the remaining two corner places of the second housing, slits are provided at two corner places of the first housing, and slit ribs are provided at the remaining two corner places of the first housing. Further, slit ribs may be provided at the four corner places of the second housing, and slits may be provided at the four corner places of the first housing. By providing the slits and the slit ribs at the corners, it is possible to prevent a deviation in a direction of rotation centering on the direction of mating, and it is possible to enhance the strength of the members from the standpoint of forming. Further, because the cross sections of the first housing and the second housing are formed of rectangular shapes, it is possible to prevent a deviation in a direction of rotation centering on the direction of mating of the first housing and the second housing. As a result, the first housing and the second housing are fixed to be coupled, and it is possible to prevent a deviation from being caused in the joining between the first housing and the second housing even in an environment resistant to high-acceleration. Accordingly, it is possible to prevent abrasion among the joining terminals of the first housing and the second housing.

(4)

A plurality of recessed slits may be formed in the direction of mating in any one of the first housing and the second housing, and projection shapes mating with the plurality of recessed slits may be further provided to any other one of the first housing and the second housing.

In this case, at the time of mating of the first housing and the second housing, not only mating of the slits with the slit ribs, but also mating of the recessed slits with the projection shapes can be obtained. As a result, the first housing and the second housing are further fixed to be coupled, which makes it possible to prevent a deviation from being caused in the joining between the first housing and the second housing even in an environment resistant to high-acceleration. Accordingly, it is possible to reliably prevent abrasion among the joining terminals of the first housing and the second housing.

(5)

It is preferable for the plurality of recessed slits and the projection shapes provided to any one of the first housing and the second housing to be capable of preventing inverse-mating of the first housing and the second housing because a distance between one of recessed slits or projection shapes and another one of recessed slits or projection shapes adjacent to said one is different from a distance between another one of recessed slits or projection shapes and yet another one of recessed slits or projection shapes adjacent to said other, among the plurality of recessed slits and the projection shapes.

In this case, among the plurality of recessed slits and the projection shapes, a distance from one of recessed slits or projection shapes to another one of recessed slits or projection shapes is different from a distance to yet another one of recessed slits or projection shapes. As a result, the plurality of recessed slits and the projection shapes strike against one another in a case of inverse-mating of the first housing and the second housing. As a result, it is possible to reliably prevent inverse-mating of the first housing and the second housing.

(6)

It is preferable for the plurality of recessed slits and the projection shapes provided to any one of the first housing and the second housing to be capable of preventing inverse-mating of the first housing and the second housing because (i) a width of plural pairs each including a recessed slit and a projection shape and (ii) a width of other plural pairs each including a recessed slit and a projection shape are different from one another, among the plurality of recessed slits and the projection shapes.

In this case, in the plurality of recessed slits and the projection shapes provided to any one of the first housing and the second housing, a width of plural pairs each including a recessed slit and a projection shape is different from a width of other plural pairs each including a recessed slit and a projection shape, among the plurality of recessed slits and projection shapes. As a result, some of the projection shapes strike against the plurality of recessed slits in a case of inverse-mating of the first housing and the second housing. As a result, it is possible to more reliably prevent inverse-mating of the first housing and the second housing.

(7)

One or a plurality of rib shapes including at least one of a cross shape, a T-shape, and a trapezoidal shape on a cross section perpendicular to the direction of mating may be formed in the vicinity of the positions at which the joining terminals are installed in any one of the first housing and the second housing, and slit shapes capable of holding cross-sectionally cross-shaped, T-shaped, and trapezoidal-shaped ribs may be formed in any other one of the first housing and the second housing.

In this case, because the rib shapes including at least one of a cross shape, a T-shape, and a trapezoidal shape are formed in the vicinity of the positions at which the joining terminals are installed, it is possible to suppress vibration in a direction of rotation (direction of torsion) centering on the direction of mating of the first housing and the second housing. As a result, it is possible to reliably prevent abrasion among the joining terminals of the first housing and the second housing.

BEST MODE FOR CARRYING OUT THE INVENTION

Hereinafter, an embodiment according to the present invention will be described. In the embodiment, an electrical connector will be explained with an example of a connector.

One Embodiment

Figure 1:
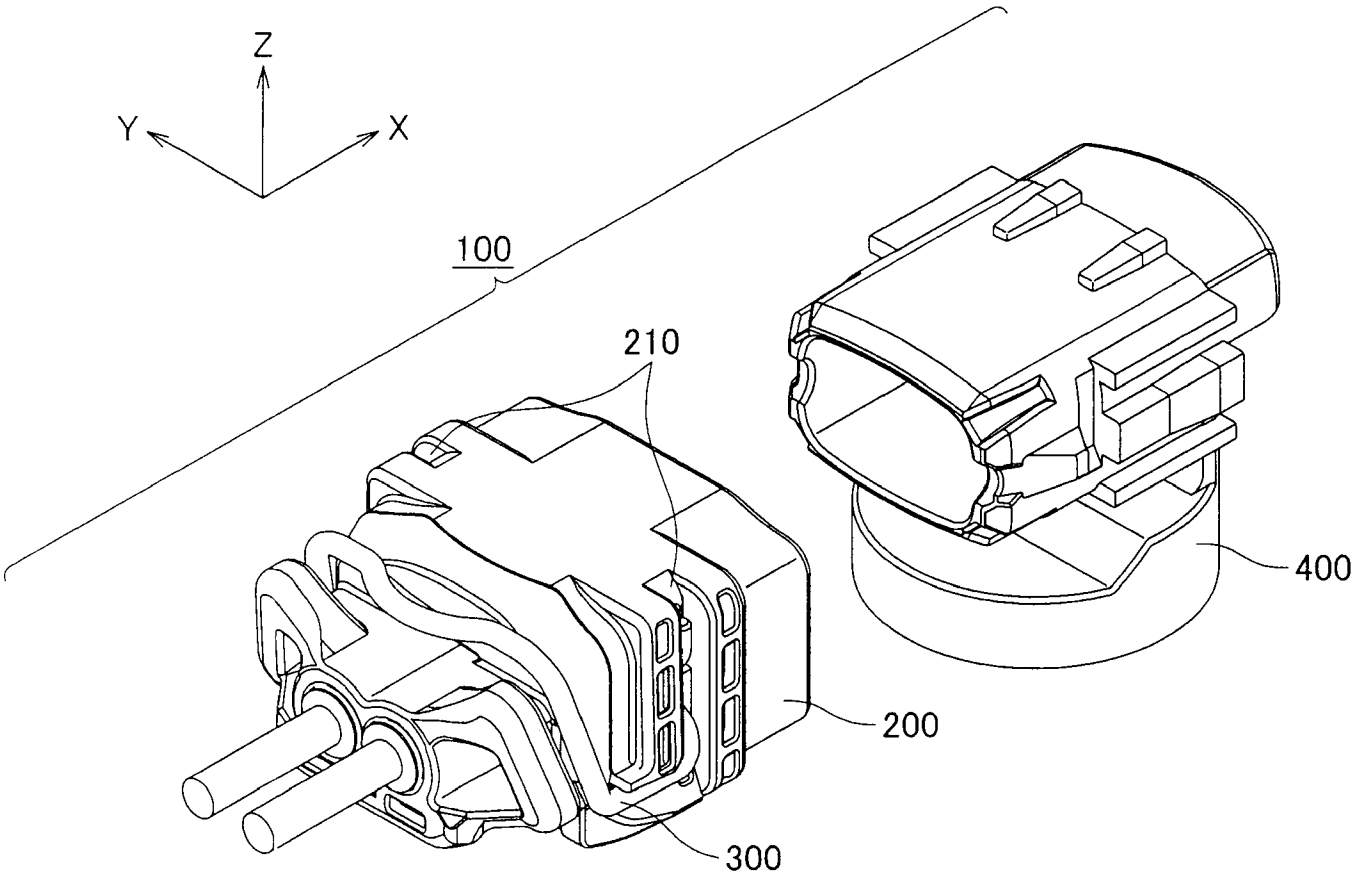
FIG. 1 is a schematic perspective view showing one example of an electrical connector according to one embodiment of the present invention.

FIG. 1 is a schematic perspective view showing one example of an electrical connector 100 according to one embodiment of the present invention.

As shown in FIG. 1, the electrical connector 100 according to the present embodiment includes a female housing 200, a latch metal 300, and a male housing 400.

As shown in FIG. 1, guide ways 210 are provided in a direction parallel to a direction (a direction of an arrow Z in the drawing) perpendicular to a direction in which the housing 200 and the male housing 400 are made to mate with one another (a direction of an arrow X in the drawing) in the female housing 200. The latch metal 300 is pressed (from the direction of the arrow Z toward the direction of −Z) to fit into the guide ways 210 of the female housing 200.

A pair of first joining terminals 201*a* and 201*b* (refer to FIG. 2) are provided inside the female housing 200 of FIG. 1. In the same way, a pair of second joining terminals 401*a* and 401*b* (refer to FIG. 3) are provided inside the male housing 400 of FIG. 1.

Figure 3:
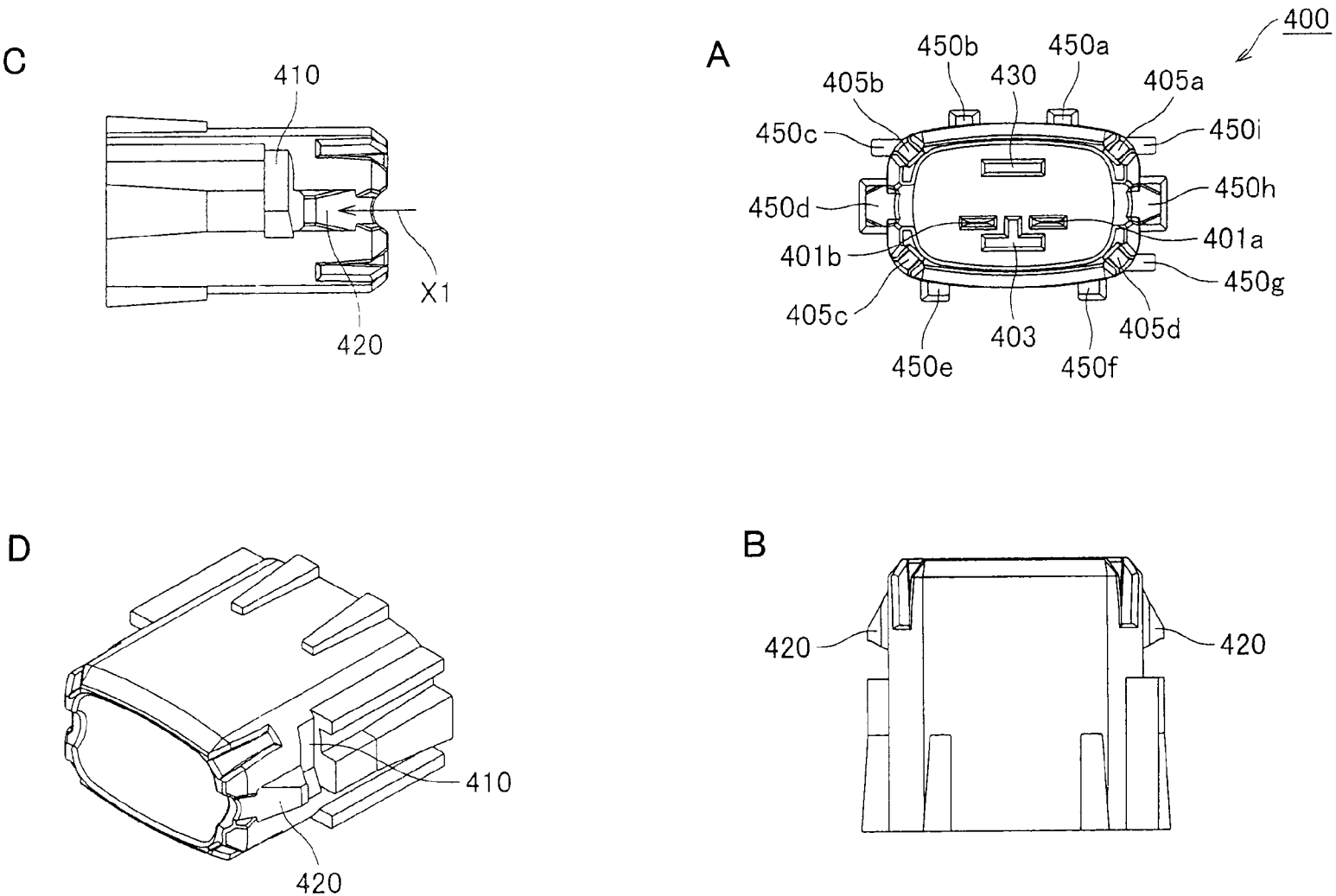
FIG. 3 is a schematic view for explanation of a shape of a male housing.

On the other hand, electrical wirings are connected to the second joining terminals 401*a* and 401*b* provided inside the male housing 400 (refer to FIG. 3).

The details will be described later. Due to the male housing 400 being inserted to mate with the female housing 200, the first joining terminal 201*a* and the second joining terminal 401*a*, and the first joining terminal 201*b* and the second joining terminal 401*b* are respectively joined to make an attempt of electrical continuity.

Next, the shapes of the female housing 200 having the latch metal 300 and the male housing 400 will be described in detail. Next, a state in which the male housing 400 is inserted to mate with the female housing 200 having the latch metal 300 will be described.

Figure 2:
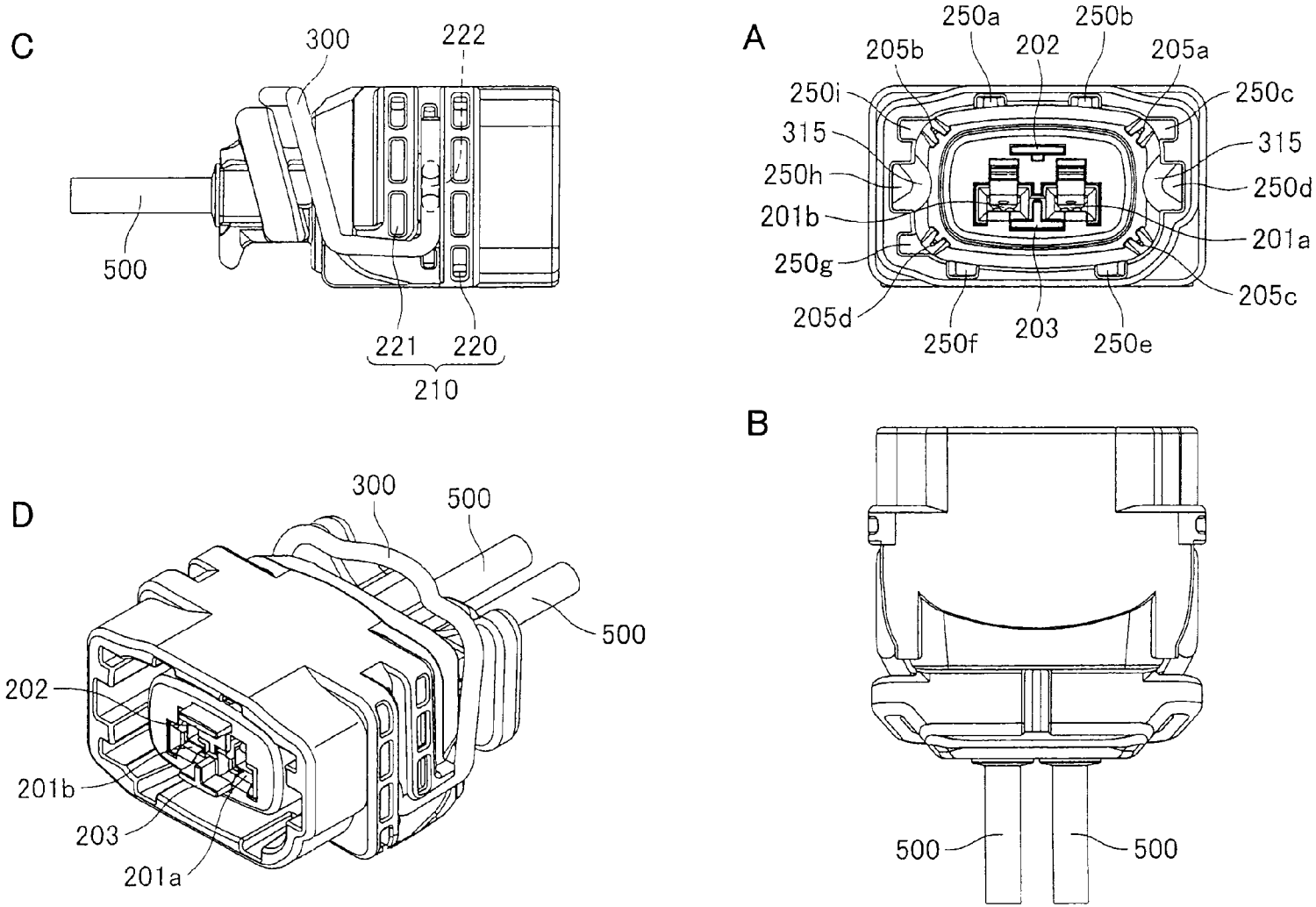
FIG. 2 is a schematic view for explanation of a shape of a female housing having a latch metal.

FIG. 2 is a schematic view for explanation of the shape of the female housing 200 having the latch metal 300. FIG. 2A shows a front view of the female housing 200, FIG. 2B shows a top view of the female housing 200, FIG. 2C shows a side view of the female housing 200, and FIG. 2D shows an appearance perspective view of the female housing 200.

The female housing 200 shown in FIG. 2 has a substantially square tubular shape externally enwrapping a substantially square tubular shape of the male housing 400 which will be described later (refer to FIG. 3).

As shown in FIG. 2A, the first joining terminals 201*a* and 201*b* are provided inside the female housing 200. A number of poles of the electrical connector 100 according to the present embodiment is two. Therefore, the first joining terminals 201*a* and 201*b* are provided side by side.

As shown in FIG. 2A, a rectangular rib 202 and a T-rib 203 are formed inside the female housing 200. Tapered shapes are respectively formed as these rectangular rib 202 and T-rib 203. The tapered shapes are provided for making insertion of the first joining terminals 201*a* and 201*b* and the second joining terminals 401*a* and 401*b* of the male housing 400 which will be described later smooth, and for improving the degrees of adhesion between the rectangular rib 202 and the T-rib 203, and a rectangular slit 402 and a T-slit 403 of the male housing 400 which will be described later at the time of mating.

Moreover, the shapes of these rectangular rib 202 and T-rib 203 are provided for preventing inverse-mating of the male housing 400 and the female housing 200. That is, this is because the rectangular rib 202 and the T-slit 403 do not mate with one another, and the T-rib 203 and the rectangular slit 402 do not mate with one another. Further, the shapes of these rectangular rib 202 and T-rib 203 have a torsion-proof effect centering on the direction of the arrow X. The details of the torsion-proof will be described later.

Further, as shown in FIG. 2A, slit ribs 205*a*, 205*b*, 205*c*, and 205*d* are provided on the four corners of the female housing 200. These slit ribs 205*a*, 205*b*, 205*c*, and 205*d* are provided so as to contact slits 405*a*, 405*b*, 405*c*, and 405*d* of the male housing 400 at the time of completion of the mating of the female housing 200 and the male housing 400 which will be described later. The details of couplings of these slit ribs 205*a*, 205*b*, 205*c*, and 205*d*, and the slits 405*a*, 405*b*, 405*c*, and 405*d* will be described later.

Moreover, slits 250*a* and 250*b* are provided on one plane of the respective planes of the female housing 200, slits 250*c* and 250*d* are provided on another plane, slits 250*e* and 250*f* are provided on yet another plane, and slits 250*g*, 250*h*, and 250*i* are provided on the other plane.

These slits 205*a* to 205*i* are provided so as to contact ribs 450*a* to 450*i* of the male housing 400 at the time of completion of the mating of the female housing 200 and the male housing 400 which will be described later.

Further, tapered shapes whose width is narrowed outward from the center are provided to these ribs 205*a*, 205*b*, 205*c*, and 205*d*, and the slits 250*a* to 250*i*. The details of the tapered shapes will be described later.

Next, as shown in FIG. 2C, the guide ways 210 are formed in a direction parallel to the direction of the arrow Z (refer to FIG. 1) on the side faces of the female housing 200. The guide ways 210 include upstanding walls 220 and 221 and opening portions (through-holes) 222. Further, the opening portions 222 are provided in the substantially central parts of the guide ways 210.

Next, as shown in FIGS. 2B and 2C, cables 500 connected to the first joining terminals 201*a* and 201*b* (refer to FIG. 2A) are led out to the end of the female housing 200 in the direction of the arrow X (refer to FIG. 1).

Further, the latch metal 300 provided to the female housing 200 in FIG. 2 is composed of metal having spring force. For example, the latch metal 300 is formed from a metal material such as spring steel or a stainless steel. Further, in accordance with a state of use of the latch metal 300, coating processing and the like may be applied thereto. For example, when an attempt is made to improve the weather resistance or the corrosion resistance of the latch metal 300, galvanization, paint application, chromate treatment, or the like is applied thereto.

Further, as shown in FIG. 2D, the latch metal 300 is formed by inflecting one member whose cross section has a substantially circular form. Latch parts 315 (refer to FIG. 2A) formed to be curved so as to have elasticity in the direction of the center of the female housing 200 with respect to the above-described opening portions 222 are provided to the latch metal 300.

The latch metal 300 is provided to be slidable in the direction of the arrow Z along the guide ways 210 of the female housing 200. When the latch metal 300 is made to slide in the direction of the arrow Z, the latch parts 315 (refer to FIG. 2A or FIG. 4) provided so as to project from the opening portions 222 of the guide ways 210 toward the central part of the female housing 200 move along the guide ways 210 not to project from the opening portions 222. The details of this movement will be described later.

Next, FIG. 3 is a schematic view for explanation of the shape of the male housing 400. FIG. 3A shows a front view of the male housing 400, FIG. 3B shows a top view of the male housing 400, FIG. 3C shows a side view of the male housing 400, and FIG. 3D shows an appearance perspective view of the male housing 400.

The male housing 400 shown in FIG. 3 has a substantially square tubular shape internally enwrapped by the substantially square tubular shape of the female housing 200 described above.

As shown in FIG. 3A, the second joining terminals 401*a* and 401*b* are provided inside the male housing 400. In the same way as the first joining terminals of FIG. 2A, a number of the poles of the electrical connector 100 according to the present embodiment is two. Therefore, the second joining terminals 401*a* and 401*b* are provided side by side. At the time of mating of the male housing 400 and the female housing 200, the second joining terminal 401*a* is connected to the first joining terminal 201*a* of FIG. 2, and the second joining terminal 401*b* is connected to the first joining terminal 201*b* of FIG. 2.

As shown in FIG. 3A, the rectangular slit 402 and the T-slit 403 are formed inside the female housing 400. Tapered shapes are formed as these rectangular slit 402 and T-slit 403. The tapered shapes are provided for making insertion of the second joining terminals 401*a* and 401*b* and the first joining terminals 201*a* and 201*b* of the female housing 200 smooth, and for improving the degrees of adhesion between the rectangular slit 402 and the T-slit 403, and the rectangular rib 202 and the T-rib 203 at the time of mating.

Moreover, the shapes of the rectangular slit 402 and T-slit 403 are provided so as to have different shapes for preventing inverse-mating of the male housing 400 and the female housing 200. Further, by providing the rectangular slit 402 and the T-slit 403, it is possible to improve the resistance characteristic in a direction of torsion at the time of mating of the female housing 200 and the male housing 400.

Further, as shown in FIG. 3A, the slits 405*a*, 405*b*, 405*c*, and 405*d* are provided on the four corners of the male housing 400. The slits 405*a*, 405*b*, 405*c*, and 405*d* are provided so as to contact the slit ribs 205*a*, 205*b*, 205*c*, and 205*d* inside the female housing 200 at the time of completion of the mating of the male housing 400 and the female housing 200.

Moreover, the ribs 450*a* and 450*b* are provided on one plane of the respective planes of the male housing 400, ribs 450*c*, 450*d*, and 450*e* are provided on another plane, ribs 450*f* and 450*g* are provided on yet another plane, and ribs 450*h* and 450*i* are provided on the other plane. These ribs 450*a* to 450*i* are provided so as to contact the slits 250*a* to 250*i* of the female housing 200 at the time of completion of the mating of the male housing 400 and the female housing 200.

Further, tapered shapes whose width is narrowed outward from the center are provided as these slits 405*a*, 405*b*, 405*c*, and 405*d*, and the ribs 450*a* to 450*i*.

In addition, in the present embodiment, the slits 405*a*, 405*b*, 405*c*, and 405*d* are provided on the four corners of the male housing 400, and the ribs 450*a* to 450*i* are provided on the respective planes, and the ribs 205*a*, 205*b*, 205*c*, and 205*d* are provided on the four corners of the female housing 200, and the slits 250*a* to 250*i* are provided on the respective planes. However, these are not limited, and any rib and any slit may be provided at the portions of mating of the male housing 400 and the female housing 200.

Further, the shapes of these ribs and slits are not limited to the above-described tapered shapes, and any other shape that improves the degree of adhesion by contacting at the time of mating of the male housing 400 and the female housing 200 may be provided.

Next, as shown in FIGS. 3C and 3D, the fixation slits 410 are formed in a direction parallel to the direction of the arrow Z (refer to FIG. 1) in the male housing 400. The fixation slits 410 are formed from slits in which a substantially V-form is formed on a cross section parallel to the plane Y-Z, and are formed such that one inclination of the substantially V-form is gradual, and the other inclination is sharp. That is, the substantially V-form is formed into a state in which the latch metal 300 is easily moved in the direction of Z, and is hard to be moved in the direction of −Z.

Further, projection shaped parts 420 are provided in a direction of an arrow X1 from the end of the male housing 400 toward the fixation slits 410.

As shown in FIG. 3B, the projection shaped parts 420 are formed into a substantially trapezoidal shape on a cross section taken along plane X-Y. Here, at the time of mating of the female housing 200 having the latch metal 300 and the male housing 400, the latch parts 315 projecting from the opening portions 222 of the female housing 200 move in the direction of the arrow X1 on the planes of the projection shaped parts 420 shown in FIG. 3C, and climb over the projection shaped parts 420 to slip down to the fixation slits 410. In this case, the latch parts 315 are sunk down in the fixation slits 410 by the elastic force of the latch metal 300. Further, when an operator presses the latch metal 300 down in the direction of −Z, the latch parts 315 move along the sides of the projection shaped parts 420 at the time of mating of the male housing 400 and the female housing 200, and when the operator stops pressing the latch metal 300 down in the direction of −Z, the latch parts 315 move in the direction of Z to slip down to the fixation slits 420. In accordance therewith, it is possible to carry out mating of the male housing 400 and the female housing 200 smoothly.

Figure 4:
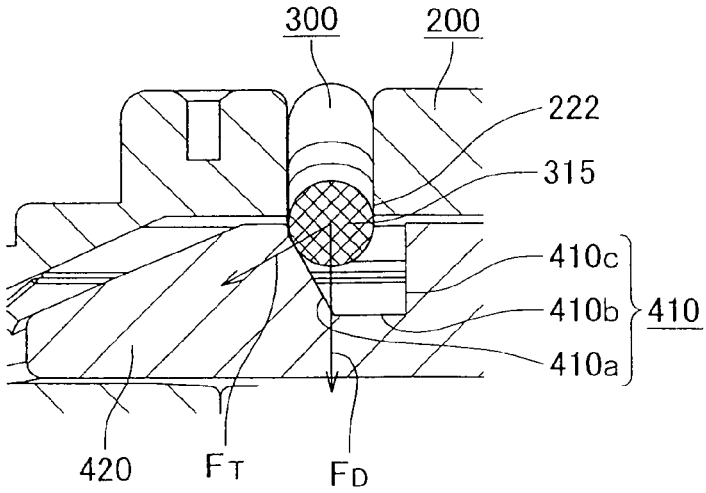
FIG. 4 is a schematic cross-sectional view for explanation of details when a latch part of the latch metal is made to mate with a fixation slit.
Figure 4:
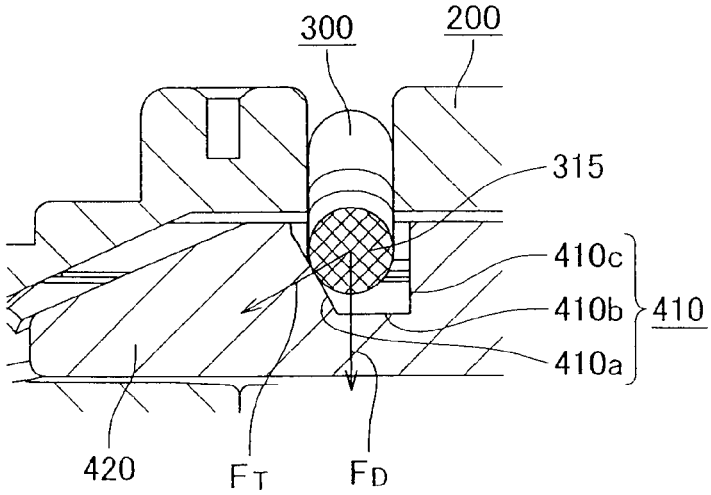
Figure 4:
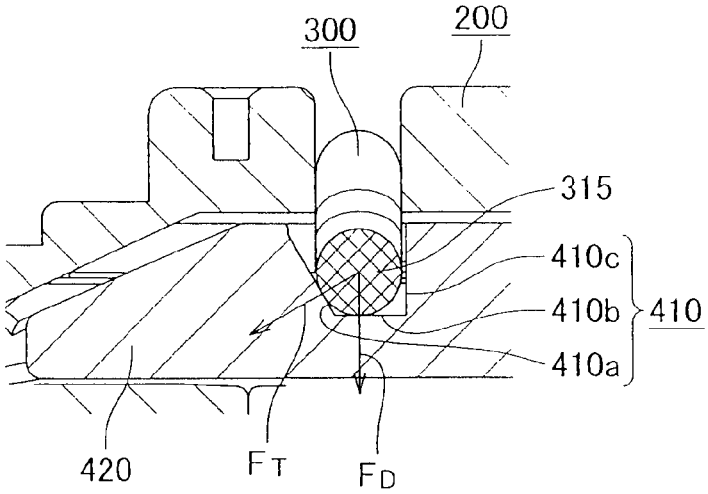

Next, FIG. 4 is a schematic cross-sectional view for explanation of details after the latch parts 315 mate with the fixation slits 410.

FIG. 4A shows a cross section at the time of mating of the female housing 200 and the male housing 400 in a state in which forming tolerance of the female housing 200 and the male housing 400 is at a maximum, FIG. 4B shows a state after change over time of the female housing 200 and the male housing 400, and FIG. 4C shows a cross section at the time of mating of the female housing 200 and the male housing 400 in a state in which forming tolerance of the female housing 200 and the male housing 400 is at a minimum.

As shown in FIG. 4A, the fixing slit 410 is formed from an inclined plane 410*a*, a bottom 410*b*, and an upstanding wall 410*c*.

As shown in FIG. 4A, in a state in which forming tolerance is varied to a maximum, the latch part 315 of the latch metal 300 projecting from the opening portions 222 of the female housing 200 is made to contact the inclined plane 410*a* of the fixation slit 410.

In this case, force FT and elastic force FD are applied between the latch part 315 of the latch metal 300 and the inclined plane 410*a*. As a result, force is applied in a direction in which the latch part 315 moves in a direction from the inclined plane 410*a* toward the bottom 410*b*, and the female housing 200 and the male housing 400 are completely fixed to one another.

Further, as shown in FIG. 4B, the fixation slit 410 is provided in a state in which the latch part 315 of the latch metal 300 projecting from the opening portion 222 of the female housing 200 contacts the inclined plane 410*a* of the fixation slit 410 even in a state in which forming tolerance is varied to a maximum and after the change over time.

In this case, in the same way as in FIG. 4A, force FT and elastic force FD are applied between the latch part 315 of the latch metal 300 and the inclined plane 410*a*. As a result, force is applied in a direction in which the latch part 315 moves in a direction from the inclined plane 410*a* toward the bottom 410*b*, and the female housing 200 and the male housing 400 are completely fixed to one another even when the female housing 200 and the male housing 400 are changed in their shapes due to a change over time or the like (for example, a creep phenomenon).

Moreover, as shown in FIG. 4C, even in a state in which forming tolerance is at a minimum, the fixation slit 410 is provided such that the latch part 315 of the latch metal 300 projecting from the opening portion 222 of the female housing 200 is made to contact not only the inclined plane 410*a*, but also the bottom 410*b* of the fixation slit 410.

In this case, in the same way as in FIGS. 4A and 4B, force FT and elastic force FD are applied between the latch part 315 of the latch metal 300 and the inclined plane 410*a*. As a result, force is applied in a direction in which the latch part 315 moves in a direction from the inclined plane 410*a* toward the bottom 410*b*, and the female housing 200 and the male housing 400 are completely fixed to one another.

Figure 5:
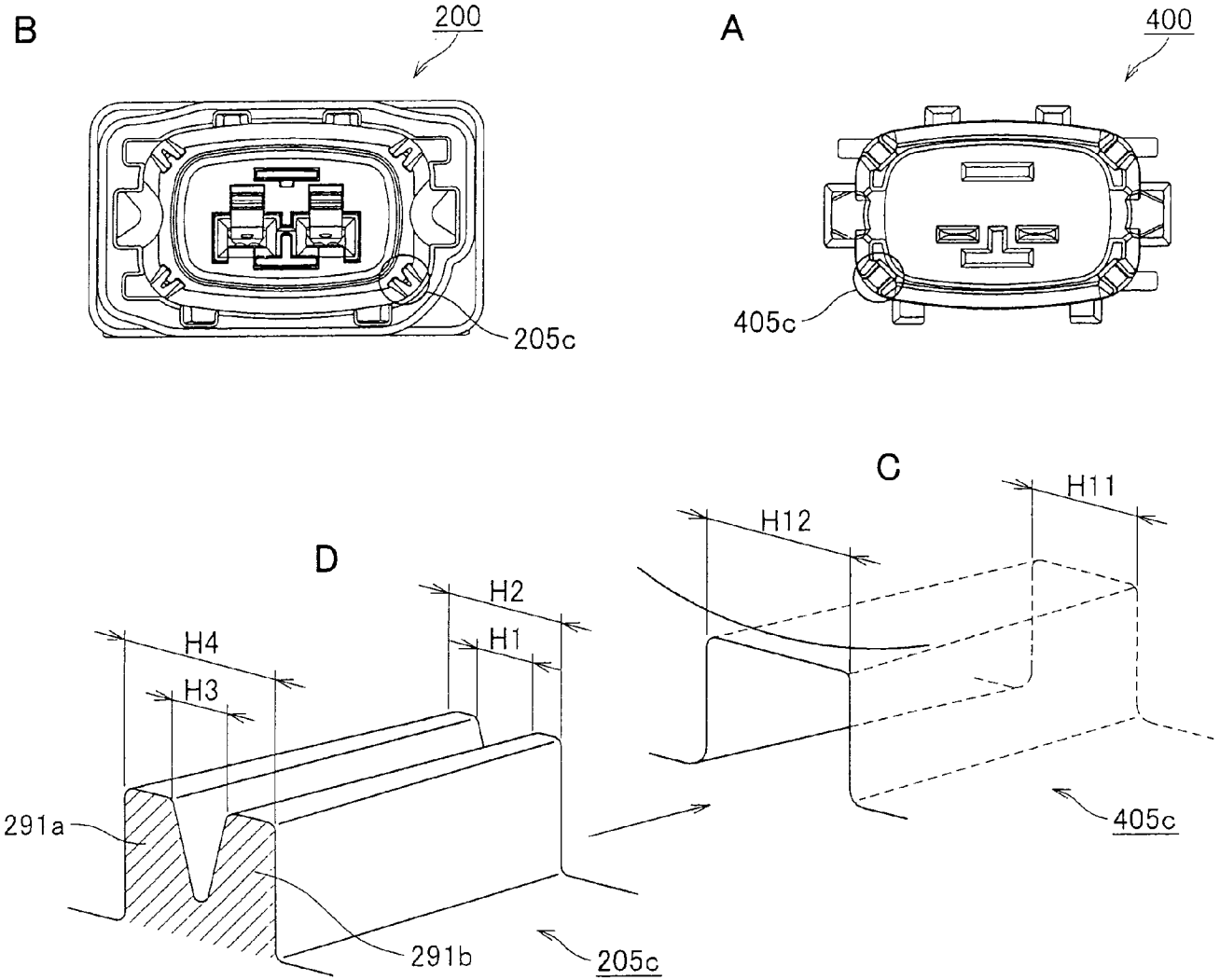
FIG. 5 is a schematic view for explanation of slit ribs in the female housing and slits in the male housing.

Next, FIG. 5 is a schematic view for explanation of the slit ribs 205*a*, 205*b*, 205*c*, and 205*d* of the female housing 200, and the slits 405*a*, 405*b*, 405*c*, and 405*d* of the male housing 400.

FIG. 5A shows a mating face of the male housing 400, FIG. 5B shows a mating face of the female housing 200, FIG. 5C shows a schematic perspective view of the slit 405*c*, and FIG. 5D shows a schematic appearance of the slit rib 205*c*.

In FIG. 5, the slit rib 205*c* among the slit ribs 205*a*, 205*b*, 205*c*, and 205*d* of the female housing 200 (refer to FIG. 5B), and the slit 405*c* among the slits 405*a*, 405*b*, 405*c*, and 405*d* of the male housing 400 (refer to FIG. 5A) are extracted for explanation. In addition, the slit ribs 205*a*, 205*b*, 205*c*, and 205*d* are formed into the same shape, and the slits 405*a*, 405*b*, 405*c*, and 405*d* as well are formed into the same shape.

As shown in FIG. 5D, the slit rib 205*c* is formed from two of a rib shape 291*a* and a rib shape 291*b*. The rib shapes 291*a* and 291*b* of the slit rib 205*c* are formed with a slit width H1 and a rib width H2 at the front edge side, and are formed with a slit width H3 and a rib width H4 at the back side of the rib.

Further, as shown in FIG. 5C, the slit 405*c* is formed with a slit entrance width H12 and a slit-back width H11.

A value (H2-H1) that the slit width H1 is subtracted from the rib width H2 becomes a value corresponding to the slit-back width H11 (refer to FIG. 5C), and a value (H4-H3) that the slit width H3 is subtracted from the rib width H4 becomes a value corresponding to the slit entrance width H12 (refer to FIG. 5C).

In this way, at the time of mating of the female housing 200 and the male housing 400, the front edge side of the slit rib 205*c* is inserted in a state of being pressure contacted by the slit width H1 at the back side of the slit 405*c*.

Further, at the time of mating of the female housing 200 and the male housing 400, the back side of the slit rib 205*c* is inserted in a state of being pressure contacted by the slit width H3 at the entrance side of the slit 405*c*.

In accordance with the above description, because the slit rib 205*c* is made to be pressure contacted by the slit width at the slit 405*c*, mating of the female housing 200 and the male housing 400 is reliably and firmly carried out.

Figure 6:
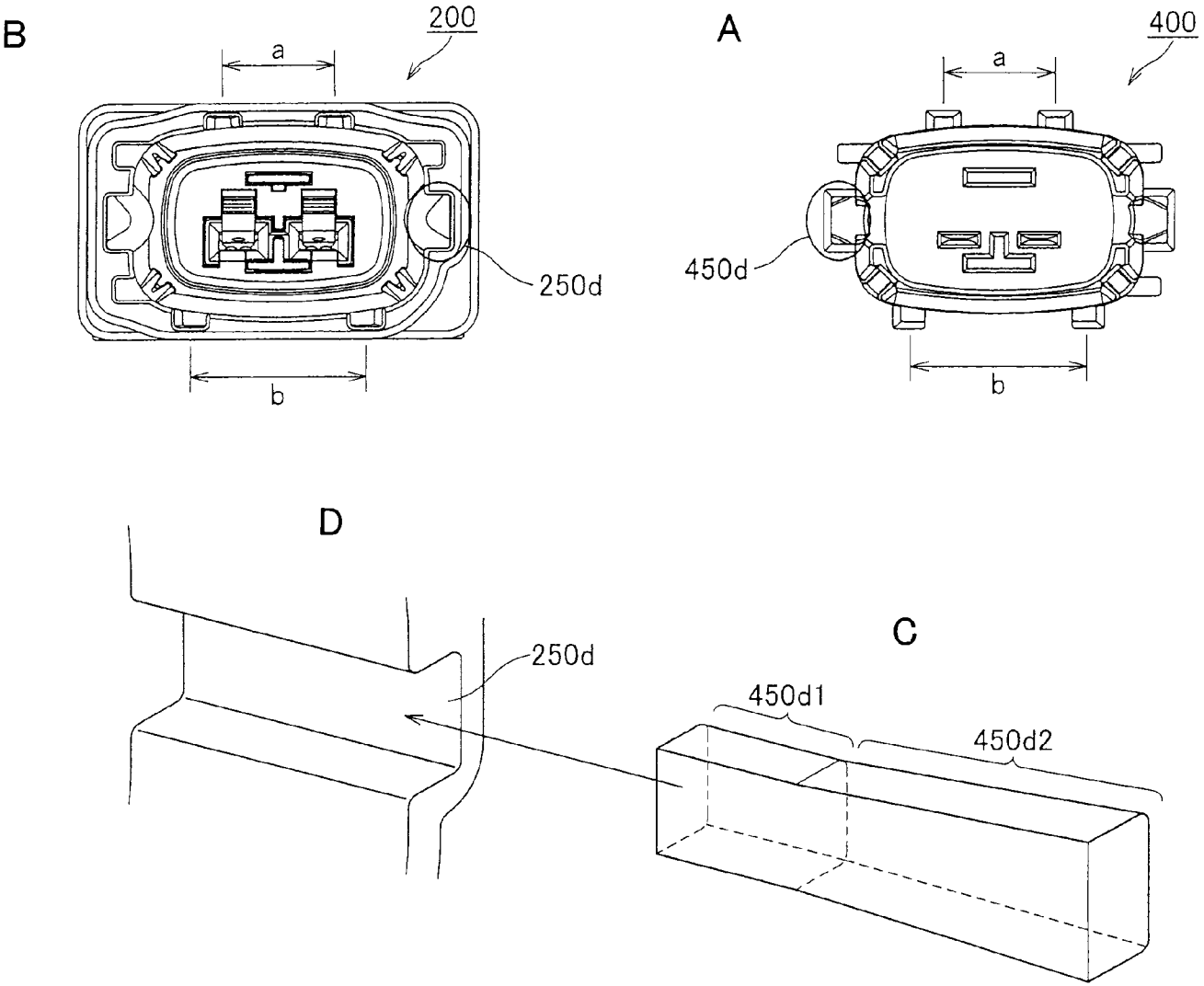
FIG. 6 is a schematic explanatory diagram showing one example of details of the slits of the female housing and the ribs of the male housing.

Next, FIG. 6 is a schematic explanatory diagram showing one example of details of the slits 250*a*, 250*b*, 250*c*, and 250*d* of the female housing 200, and the ribs 450*a*, 450*b*, 450*c*, and 450*d* of the male housing 400. In FIG. 6, the slit 250*d* and the rib 450*d* will be described.

FIG. 6A shows a mating face of the male housing 400, FIG. 6B shows a mating face of the female housing 200, FIG. 6C shows a schematic appearance of the rib 450*d*, and FIG. 6D shows a schematic appearance of the slit 250*d*.

As shown in FIG. 6C, the rib 450*d* of the male housing 400 is formed from a rib 450*d*1 composed of a square pole and a rib 450*d*2 whose rib shape becomes gradually greater. The rib 450*d*2 has a shape (a square pyramid) becoming greater in both of the horizontal and vertical directions of the rib 450*d*.

As a result, when the rib 450*d*1 is started mating with the slit 250*d* of FIG. 6D, there is a space between the both. In contrast thereto, when the rib 450*d*2 is started mating with the slit 250*d*, the rib 450*d*2 contacts therein, and there is no space between the rib 450*d* and the slit 250*d*, which makes the both mate with one another firmly.

Further, as shown in FIGS. 6A and 6B, a pitch a between the ribs 450*a* and 450*b* of the male housing 400, and a pitch b between the ribs 450*e* and 450*f* are different values, and the tapered shapes of the ribs 450*a* and 450*b* and the ribs 450*e* and 450*f* are formed at completely different angles of inclination. As a result, it is possible to reliably prevent inverse-mating of the male housing 400 and the female housing 200.

Figure 7:
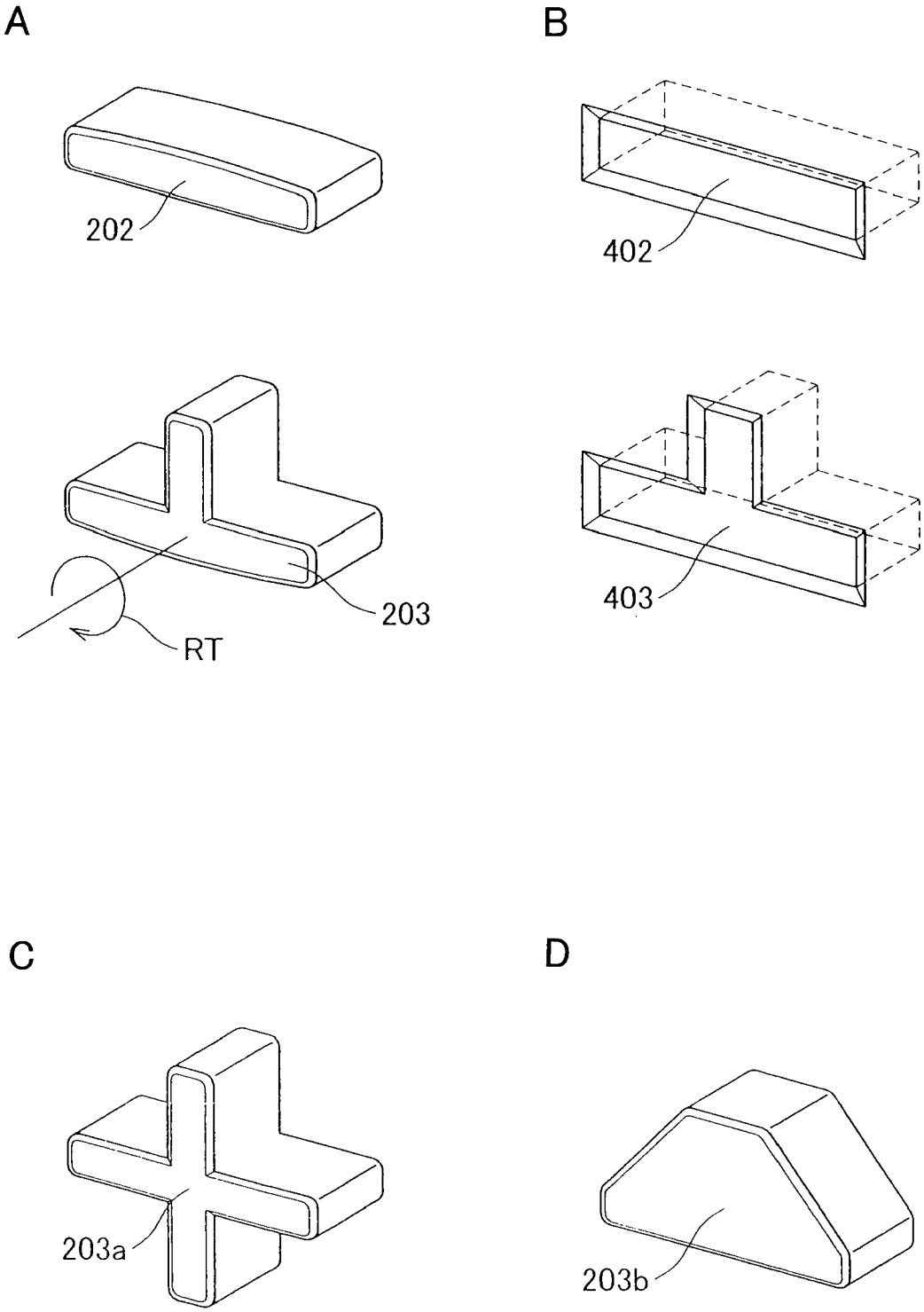
FIG. 7 is a schematic view showing relationships between a rectangular slit (a recess in the shape of rectangle) and a T-slit (a recess in the shape of "T") of the male housing and a rectangular rib and a T-rib of the female housing.

Next, FIG. 7 is a schematic view showing relationships between the rectangular slit 402 and the T-slit 403 of the male housing 400 and the rectangular rib 202 and the T-rib 203 of the female housing 200. FIG. 7A shows the rectangular rib 202 and the T-rib 203 of the female housing 200, FIG. 7B shows the rectangular slit 402 and the T-slit 403 of the male housing 400, FIG. 7C shows another example of the rectangular rib 202 and the T-rib 203 of the female housing 200, and FIG. 7D shows yet another example of the rectangular rib 202 and the T-rib 203 of the female housing 200.

As shown in FIGS. 7A and 7B, in a relationship between the T-rib 203 and the T-slit 403, it is possible to reduce an error in a direction of an arrow RT in the drawing. That is, it is possible to reduce an error in the direction of the arrow RT by a right-angle rib action of the T-rib 203.

Further, as shown in FIG. 7C, a cross rib 203*a* may be used in place of the T-rib 203, and as shown in FIG. 7D, a trapezoidal rib 203*b* may be used in place of the T-rib 203. In these cases as well, it is possible to reduce an error in the direction of the arrow RT in the drawing in the same way as the relationship between the T-rib 203 and the T-slit 403.

In addition, in the present embodiment, the T-rib 203, the T-slit 403, the cross rib 203*a*, a cross slit (not shown), the trapezoidal rib 203*b*, and a trapezoidal slit (not shown) have been shown as examples. However, these are not limited, and any other shape of a rib and a slit may be used.

Figure 8:
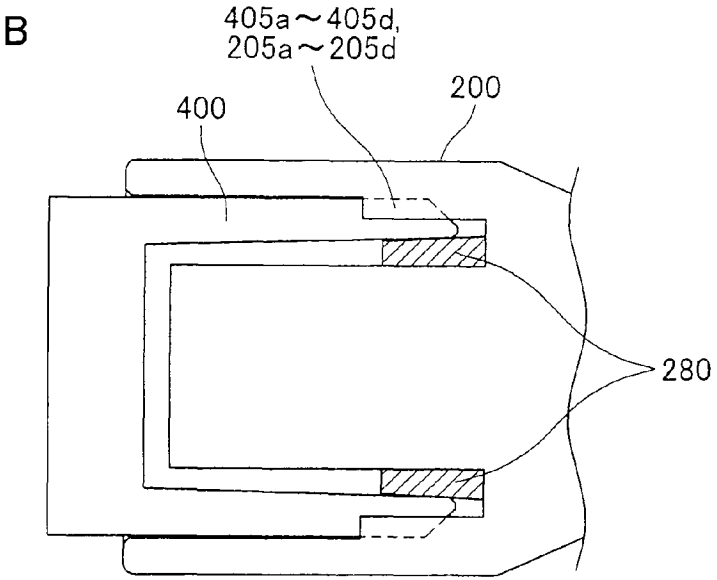
FIG. 8 is a schematic explanatory diagram for explanation of backlash preventing ribs in the female housing.
Figure 8:
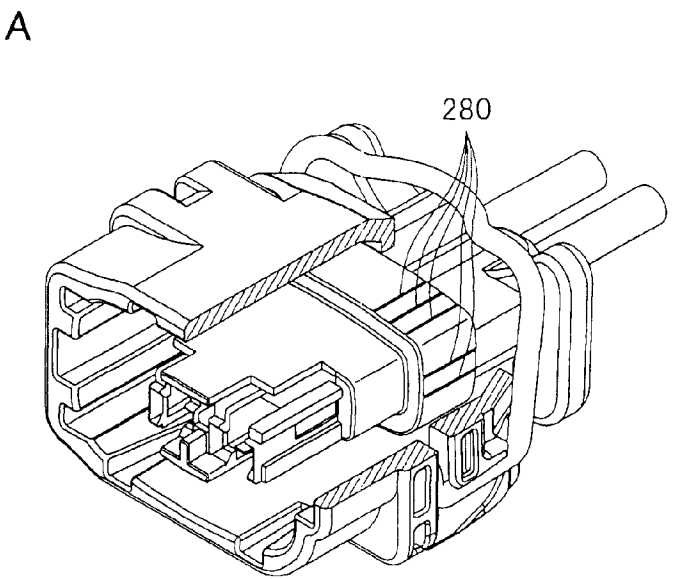

Next, FIG. 8 is a schematic explanatory diagram for explanation of backlash preventing ribs 280 of the female housing 200. FIG. 8A is a perspective view that a part of the female housing 200 is notched, and FIG. 8B is a view schematically showing a cross section of FIG. 8A.

First, as shown in FIG. 8A, the backlash preventing ribs 280 are provided inside the female housing 200. The backlash preventing ribs 280 are provided so as to be able to prevent the mating of the female housing 200 and the male housing 400 from rattling to an excessive degree when an excessive vibration is applied.

That is, as shown in FIG. 8B, in contrast to that the slit ribs 205*a* to 205*d* and the slits 250*a* to 250*i* of the female housing 200 maintain the mating by applying pressure from the out-side to the inside of the outer shape of the male housing 400, the backlash preventing ribs 280 are to prevent rattling due to excessive vibration. Accordingly, a clearance may be provided when the male housing 400 is made to mate with the female housing 200.

As described above, in the electrical connector 100 according to the present embodiment, when the slit ribs 205*a* to 205*d* of the female housing 200 are inserted into the tapered shapes of the slits 405*a* to 405*d* of the male housing 400, because a rate of angular change and a rate of width change of the slits 405*a* to 405*d* are greater than a rate of angular change and a rate of width change of the slit ribs 205*a* to 205*d*, a state in which force is always applied between the slits 405*a* to 405*d* and the slit ribs 205*a* to 205*d* is brought about. That is, the slit widths H1 and H3 of the slit ribs 205*a* to 205*d* become narrower to be inserted into the corresponding slits 405*a* to 405*d*. In accordance therewith, because force is applied in a direction in which the slit widths H1 and H3 are increased, the female housing 200 and the male housing 400 are fixed firmly. Moreover, because the mating faces between the slits 405*a* to 405*d* and the slit ribs 205*a* to 205*d* are formed into tapered shapes, it is possible to reduce the insertion force at the time of mating.

As a result, it is possible to make the female housing 200 and the male housing 400 rigid reliably, and it is possible to prevent vibration between the female housing 200 and the male housing 400 even in an environment of high-acceleration vibration. Accordingly, it is possible to suppress abrasion between the female housing 200 and the male housing 400, and to reliably keep the connections between the first joining terminals 201*a* and 201*b* and the second joining terminals 401*a* and 401*b*.

Further, by forming the slits 405*a* to 405*d* on the corner portions of the rectangular shape of the male housing 400, and forming the slit ribs 205*a* to 205*d* on the corner portions of the female housing 200, it is possible to prevent a deviation in a direction of rotation centering on the direction of mating, and it is possible to enhance the strength of the female housing 200 and the male housing 400 from the standpoint of forming.

Moreover, due to the cross sections of the female housing 200 and the male housing 400 being formed into rectangular shapes, it is possible to prevent a deviation in a direction of rotation centering on the direction of mating of the female housing 200 and the male housing 400. As a result, the female housing 200 and the male housing 400 are fixed to be coupled, and it is possible to prevent a deviation in the joining between the female housing 200 and the male housing 400 even in an environment resistant to high-acceleration. Accordingly, it is possible to prevent abrasion among the joining terminals 201*a*, 201*b*, 401*a*, and 401*b* of the female housing 200 and the male housing 400.

Moreover, at the time of mating of the female housing 200 and the male housing 400, due to not only the mating of the slits 405*a* to 405*d* and the slit ribs 205*a* to 205*d*, but also to the mating of the slits 250*a*, 250*b*, 250*c*, and 250*d* and the ribs 450*a*, 450*b*, 450*c*, and 450*d*, the female housing 200 and the male housing 400 are further fixed to be coupled, which makes it possible to prevent a deviation in the joining between the female housing 200 and the male housing 400 even in an environment resistant to high-acceleration. Accordingly, it is possible to reliably prevent abrasion among the joining terminals of the female housing 200 and the male housing 400.

Further, because a distance a of the pair of slits 250*a* and 250*b* and a distance b of the pair of slits 250*c* and 250*d* are different from one another, it is possible to further prevent inverse-mating of the female housing 200 and the male housing 400.

Further, because the rectangular rib 202 and the T-rib 203 are formed in the vicinity of the positions at which the first joining terminals 201*a* and 201*b* are installed, it is possible to suppress vibration in a direction of rotation (direction of torsion) centering on the direction of the mating of the female housing 200 and the male housing 400. As a result, it is possible to reliably prevent abrasion among the first joining terminals 201*a* and 201*b* and the second joining terminals 401*a* and 401*b* of the female housing 200 and the male housing 400.

Further, at the time of mating of the male housing 400 and the female housing 200, the latch parts 315 of the latch metal 300 locked onto the guide ways 210 of the female housing 200 project toward the male housing 400 side from the opening portions 222 of the female housing 200. Accordingly, the latch parts 315 climb over the projection shaped parts 420 to be fixed into the fixation slits 410. Accordingly even when the mating of the female housing 200 and the male housing 400 is changed due to a change over time, because these are locked at the inclined planes 410*a* of the fixation slits 410, it is possible to continue to lock the latch parts 315 by a distance corresponding to the length of the inclined planes 410*a*, and it is possible to absorb an error or tolerance of size. As a result, the electrical connector 100 can maintain the integrity secularly even when there is an error or tolerance of size, and it is possible to perform stable continuity for a long time.

In the electrical connector 100 according to the present embodiment, the first joining terminals 201*a* and 201*b* correspond to the first joining terminals, the female housing 200 corresponds to the female-type first housing, the second joining terminals 401*a* and 401*b* correspond to the second joining terminals, the male housing 400 corresponds to the male-type second housing, the guide ways 210 correspond to the slits formed in the first housing, the latch metal 300 corresponds to the latch metal, the slit ribs 205*a*, 205*b*, 205*c*, and 205*d* correspond to the slit ribs, the slits 405*a*, 405*b*, 405*c*, and 405*d* correspond to the slits, and the slits 250*a* to 250*i* correspond to the plurality of recessed slits, and the ribs 450*a* to 450*i* correspond to the projection shapes, the T-rib 203 corresponds to the rib shape including at least one of a cross shape, a T-shape, and a trapezoidal shape, the latch parts 315 correspond to the projection shaped latch parts, the opening portions 222 correspond to opening portions capable of projecting, and the inclined planes 410*a* correspond to predetermined inclined planes.

In addition, in the present embodiment, the case in which the female housing 200 is made to mate with the male housing 400 while the latch metal 300 is kept in a preload state by providing the guide ways 210 to the female housing 200 has been described. However, these are not limited, and guide ways may be provided to the male housing 400, and the latch metal 300 may be kept in a preload state.

Further, the shapes of the guide ways 210 and the latch metal 300 are not limited to these in the present embodiment, any shape by which preload acts on the latch metal 300 may be used.

Moreover, in the present embodiment, the electrical connector 100 has two poles. However, these are not limited, and any other number of poles may be provided thereto. For example, the first joining terminals supported by the first housing and the second joining terminals supported by the second housing may not be necessarily provided in pairs, and a plurality of the first joining terminals and the second joining terminals may be appropriately provided.

Further, the latch parts 315 of the latch metal 300 are provided in a pair. However, these are not limited, and any other number of latch parts may be provided thereto. Moreover, the latch metal 300 may be composed of a plurality of members.

Moreover, the electrical connector 100 in the present embodiment can be used as a connector not only in the vicinity of a power source generating high-acceleration vibration, but also in any other optional use environment. For example, by optimally selecting materials for the female housing and the male housing which are described later, the durability, the weather resistance, the waterproof property, and the like are provided to a connector, which makes it possible for the connector to be used as another connecter in all environments.

What is claimed is:

1. A connector comprising:

a female-type first housing supporting first joining terminals;

a male-type second housing supporting second joining terminals electrically connected to the first joining terminals, the second housing being inserted into the first housing to mate with the first housing; and a latch metal which is latched into slits extending in one direction perpendicular to a direction of mating of the first housing and the second housing and formed in the first housing, and biases the second housing in a direction perpendicular to both of the direction of mating and a direction of the slits, wherein any one of the first housing and the second housing includes tapered slit ribs extending in the direction of mating, the tapered slit ribs are formed at a predetermined rate of width change and a predetermined rate of angular change, any other one of the first housing and the second housing includes tapered slits which are provided at positions corresponding to the slit ribs and extend in the direction of mating of the first housing and the second housing, the tapered slits have a rate of angular change and a rate of width change which are respectively greater than the predetermined rate of angular change and the predetermined rate of width change of the slit ribs, and when the second housing is made to mate with the first housing, outer wall surfaces of the slit ribs are fitted into inner peripheral surfaces of the slits, and slits of the slit ribs become narrower, and the slit ribs are pressed to fit into the slits.

2. The connector according to claim 1, wherein the tapered slit ribs and the tapered slits are provided in at least three pairs or more respectively to the first housing and the second housing.

3. The connector according to claim 2, wherein the second housing is formed such that a shape of cross section on a plane perpendicular to the direction of mating is a rectangular shape, and any one of the slits and the slit ribs is formed on every corner portion of the rectangular shape, and the first housing is formed of a rectangular shape which covers a periphery of the second housing, and capable of mating with the shape of the cross section of the second housing, and any other one of the slit ribs and the slits capable of mating with the one of the slits and the slit ribs of the second housing formed on every corner portion of the rectangular shape of the second housing is formed thereon.

4. The connector according to any one of claims 1 to 3, wherein a plurality of recessed slits are formed in the direction of mating in any one of the first housing and the second housing, and projection shapes made to mate with the plurality of recessed slits are further provided to any other one of the first housing and the second housing.

5. The connector according to claim 4, wherein among the plurality of recessed slits and the projection shapes provided to any one of the first housing and the second housing, a distance between one of recessed slits or projection shapes and another one of recessed slits or projection shapes adjacent to said one is different from a distance between another one of recessed slits or projection shapes and yet another one of recessed slits or projection shapes adjacent to said other so as to prevent inverse-mating of the first housing and the second housing.

6. The connector according to claim 4, wherein among the plurality of recessed slits and the projection shapes provided to any one of the first housing and the second housing, (i) a width of plural pairs each including recessed slit and a projection shape and (ii) a width of other plural pairs each including a recessed slit and a projection shape are different from one another so as to prevent inverse-mating of the first housing and the second housing.

7. The connector according to claim 1, wherein one or a plurality of rib shapes including at least one of a cross shape, a T-shape, and a trapezoidal shape on a cross section perpendicular to the direction of mating are formed in the vicinity of positions at which the joining terminals are installed in any one of the first housing and the second housing, and slit shapes capable of holding cross-sectionally cross-shaped, T-shaped, and trapezoidal-shaped ribs are formed in any other one of the first housing and the second housing.

* * * * *